United States Patent [19]

Weihrauch

[11] Patent Number: 4,589,791

[45] Date of Patent: May 20, 1986

[54] DEVICE HAVING SYNTHETIC BRISTLES BUTT WELDED TO SUPPORT PLATE

[75] Inventor: Georg Weihrauch, Wald-Michelbach, Fed. Rep. of Germany

[73] Assignee: Coronet-Werke Heinrich Schlerf GmbH, Fed. Rep. of Germany

[21] Appl. No.: 554,081

[22] Filed: Nov. 21, 1983

[30] Foreign Application Priority Data

Nov. 19, 1982 [DE] Fed. Rep. of Germany ..... 3242757

[51] Int. Cl.[4] ..... A46B 11/00; A46B 3/00

[52] U.S. Cl. ..... 401/290; 300/21; 401/13; 401/268; 401/284; 401/286; 401/287; 401/291

[58] Field of Search ..... 401/13, 268, 291, 284, 401/190, 272, 286, 290, 287; 15/186, 159 A; 300/21

[56] References Cited

U.S. PATENT DOCUMENTS

| | | | |
|---|---|---|---|
| 1,082,934 | 12/1913 | Coriell | 401/290 X |
| 1,661,358 | 3/1928 | Brake | 401/291 |
| 2,562,716 | 7/1951 | Hervey | 300/21 |
| 2,652,580 | 9/1953 | Neugass | 300/21 X |
| 3,815,923 | 6/1974 | Goduto | 15/159 A X |

FOREIGN PATENT DOCUMENTS

| | | | |
|---|---|---|---|
| 226624 | 3/1963 | Austria | 401/291 |
| 477236 | 10/1969 | Fed. Rep. of Germany | 401/268 |
| 2841265 | 4/1980 | Fed. Rep. of Germany | 401/286 |
| 11452 | 2/1902 | Norway | 401/13 |
| 999593 | 7/1965 | United Kingdom | 401/190 |
| 1066570 | 4/1967 | United Kingdom | 401/291 |

*Primary Examiner*—Steven A. Bratlie

*Attorney, Agent, or Firm*—Antonelli, Terry & Wands

[57] ABSTRACT

A device for applying liquid agents by synthetic bristles which, combined into bundles, are fixed on a plastic supporting base, with the supporting base being thin-walled and having several openings at least one of which is surrounded by a bundle of bristles. The bristles are butt-welded onto the supporting base, with the bristles leaving open a cross section of the opening and forming a duct tapering off toward the bristle ends, which duct leads or supplies the agent into a working area of the device.

14 Claims, 10 Drawing Figures

DEVICE HAVING SYNTHETIC BRISTLES BUTT WELDED TO SUPPORT PLATE

This invention relates to a device for applying liquid agents by synthetic bristles which, combined into bundles, are fixed on a plastic supporting base forming a part of a container holding or guiding the agent, with the plastic supporting base being provided with openings for supplying the agent to the bristles, and with the bristles of a bundle surrounding at least one hole in the supporting base while forming a duct that guides the agent to ends of the bristles opposite the supporting plate.

Devices of the above-mentioned design are used for applying liquid and pasty agents to surfaces of different types of objects. Thus, in, for example, U.S. Pat. No. 2,603,805 DE-GM 1,803,125 cleaning brushes are known which include a hollow brush housing provided with a water supply connection and with duct-shaped openings at a bottom of the housing. The bottom of the housing also serves at the supporting base for the bristle attachment. In U.S. Pat. No. 2,603,805, the supporting base, i.e., the bottom of the brush, has bores between the duct-shaped openings into which bundles of bristles are inserted in a conventional manner. The brush is connected to a water faucet so that, during the cleaning of a surface, the water comes out between the bundles of bristles and wets the surface. The cleansing agent is therefore applied simultaneously with the cleaning motion. Because of the grid-shaped arrangement of the openings on the one hand and the bundles of bristles on the other hand, the water is distributed well. In the DE-GM 1 803 125, each bundle of bristles, at one of end thereof, is provided with a plastic head that can be inserted into an opening at the bottom of the brush housing and is locked therein. The head is provided with a central duct through which the liquid from the brush housing can exit and be supplied to the bundle of bristles. The bristles are to be connected with the head by a polymerization process. However, technically this cannot be carried out. While, in the case of cleaning brushes, it does not matter whether the cleaning water is delivered in small proportioned quantities, it is desirable, for example, during a brush application using paints or pastes, that the agent is supplied in only relatively small amounts according to the requirement when it is applied to a surface. In order to achieve this, either several openings are provided in the supporting base at the bristle base such as proposed in DE-OS 28 41 264 wherein a bundle of bristles are individually puttied into the openings in a conventional manner, or such as proposed in DE-PS 646 288 wherein the bristle base of the brush forms the lid of a container that is provided with a central bore for supplying the agent held in the container to the bristles. In this case, a valve for adjusting the overflowing amount is disposed between the container and the lid. Here also, the bristles, in a conventional manner, are puttied into the cup-shaped base. In the former case, capillary tubes are inserted into the openings of the base that reach almost to the ends of the bristles and through which the agent reaches one bundle of bristles each coming out of the container of the device. However, a proportioned supply of the agent is not possible in this case because the bristles are arranged in parallel, and the agent can, therefore, almost without resistance, penetrate the bundle of bristles. In addition, the inserted capillary tubes are generally stiffer than the material of the bristles resulting in impairing the application of the agent.

With the exception of the above-described cleaning brushes, the above-mentioned devices have not been successful because, on the one hand, the manufacturing is much too expensive and, on the other hand, the delivery of small, proportional amounts required for the application of agents is not possible. The invention is therefore based on the task of developing the initially mentioned device in such a way that, on the one hand, it can be realized without significant difficulties from the point of view of manufacturing and, on the other hand, permits the proportioned application also of small amounts of liquid agents without requiring special proportioning devices or similar means.

According to the invention, this objective is achieved by the fact that the plastic supporting base for the bristles has thin walls, and the bristles of the bundle are butt-welded onto the base leaving the opening free.

In the case of the construction according to the invention, the supporting base and the bristles must naturally be made of plastics that can be welded together. Such materials, for example, nylon, polyethylene, polypropylene etc., are known. According to the invention, the supporting base must be thin-walled so that, during the welding process, the heat transfer at the ends of the bristles as well as at the supporting base is about equally good, and thus the fusing of both areas takes place uniformly and simultaneously. By means of the butt-welding of the bundles of bristles onto the base, on the one hand, and the simultaneous leaving-open of the opening at the base, the bristles of each bundle may be attached in such a position that at least the inside bristles bend considerably toward the inside and because of their flexibility, are located close to one another. Thus, a duct is formed that tapers off from the opening toward the ends of the the bristles, with the duct, because of the close adjoining of the bristles in the area of the ends of the bristles, forming a type of closure. The agent held in a container or being guided by a container can come out only when the resistance provided by the closely adjoining bristles is eliminated so that the tapered duct opens up. This may take place because the container includes, for example, a deformable material that returns to its original shape so that the agent held in it, by a pressing-together of the container, can be placed under a slight excess pressure. The agent will, through the openings in the supporting base forming a part of the container, exit from the container and flow into the tapered ducts, in which case the bristles yield under the effect of the excess pressure and the agent can come out. The same effect can also be achieved by the application itself when, during the brushing-over of the surface to be treated, the bristles are bent and spread in the known manner so that the ducts open or the resistance existing there is reduced and the agent can come out.

To a limited extent, the length of the ducts, because of the butt-welding of the bristles onto the base, can be predetermined by, for example, closely embracing the bristles during the welding process at varying distances from the free ends by means of which the angle of slope especially of the inside bristles can be varied. Shorter ducts are provided mainly in the case of agents of low viscosity, and long ducts are provided in the case of of agents of higher viscosity. These ducts also serve as storage chambers so that when the device is used, the agent is immediately available for delivery.

Tests have shown that by means of a device developed according to the invention different types of agents, such as cleaning and cleansing pastes, detergent concentrates, agents for the care of metallic surfaces, hair dyes and conditioners, pastry decorating substances, thixotropic liquids, like wood preservatives, etc., can be applied.

According to an embodiment of the invention, the bristles of one bundle each are arranged at a distance from the edge of the opening. This has the effect that the angle of slope of the inside bristles and thus the frictional connection in the area of the ends of the bristles can be increased further or the closure of the duct formed by them can be intensified.

According to another embodiment, the bristles of one bundle surround several openings in the supporting base while forming only one duct. By this design, the amount of the agent to be delivered via one duct can be increased. However, at the same time, the large number of smaller openings makes it possible that also this larger amount flows into the bristle duct in a throttled manner and that there is no large and exceedingly rapid delivery of the agent. The thin-walled supporting base of the bristles can be developed directly as the lid of a container or as a part of the container, in which case the container can preferably be collapsed.

The butt-welding of the bristles on the thin-walled base also creates the possibility that the openings in the supporting base must not necessarily be circular, but may be oval, angular, slot- or stem-shaped. This results in another possibility of throttling the agent or of a proportioned supply of the agent to the bristles. Such cross-sectional shapes are not possible in the case of the conventional puttying-in, gluing-in or other insertion of the bristles.

The fixing of the bristles according to the invention also makes it possible that each bundle of bristles consists of a mixture of different types of bristles. For example, round bristles of different diameters can be used within one bundle of bristles resulting in an especially good closing effect at the end of the bristles. However, bristles of a triangular or oval cross section may also be used in order to, for example, achieve varying capillary effects within one bundle. It is also possible to attach each bundle or some of the bundles in an angular contour which cannot be realized by means of conventional manufacturing techniques.

According to another embodiment of the invention, the thin-walled supporting base is pliable. This embodiment is significant especially for bristle-type devices, by curving the support base in the initial form in such a way that the bundles of bristles hold the agent like pliers, while by a slight bending of the supporting base, the frictional connection between the bristles is decreased and the agent is delivered. It has been found that in this manner even powdered cleansing agents can be applied in a dosed manner. Because of the tight closure of the ducts guiding the agent, it is also possible that some of the ducts formed by the bundles of bristles are connected to a device for the return of the agent that is not adhering in the work area and is superfluous. Thus the agent may, for example, come out of one part of the bundles of bristles under a slight excess pressure, while it is taken in by another part of the bundles of bristles by means of a suction effect. The delivering and absorbing bundles of bristles may be arranged in rows that are located behind one another, in which case the absorbing bundles of bristles are provided in a row that follows in working direction.

This invention also relates to a process for manufacturing the above-mentioned devices consisting in pushing the bristles of a bundle, at their end facing the thin-walled supporting base, from the center of the bundle toward the outside until the cross section created in the center of the bundle that is free of bristles corresponds at least to the clear cross section of an opening in the supporting base, and in butt-welding the bristles at the same time or subsequently onto the supporting base.

By this process, it is achieved that the bristles in the area close to the roots are pressed tightly together so that the agent penetrating into the duct formed by the bristles cannot escape laterally through the bristles but is forced to the ends of the bristles. As a result, the bristles in addition become sloped toward the inside so that in the direction of the bristle ends, they flexibly adjoin one another and form a closure of the duct. The butt-sinking preferably takes place according to the so-called melt-facing process, where a hot plate is disposed between the ends of the bristles and the thin-walled supporting base, the bristles and the supporting base are moved to the hot plate from opposite sides and are simultaneously molten in a thin layer. The hot plate is then pulled out, and the bundle of bristles and the supporting base are pressed together until the plastic hardens and a firm connection is made. The pushing-away of the bristles in the center can take place by corresponding pushing means arranged at the hot plate or in a different manner.

During the pushing-away of the bristles in the center of the bundles, the bundle, while maintaining its contour, is grasped on the outside in order to prevent an escaping of the bristles.

Finally, it is possible to shape the openings in the supporting base while welding the bristles onto the supporting base by, for example, pressing heated pins into the supporting base. These pins may be arranged at the hot plate itself.

In the drawings, some preferred embodiments of devices are shown.

Figure 1:
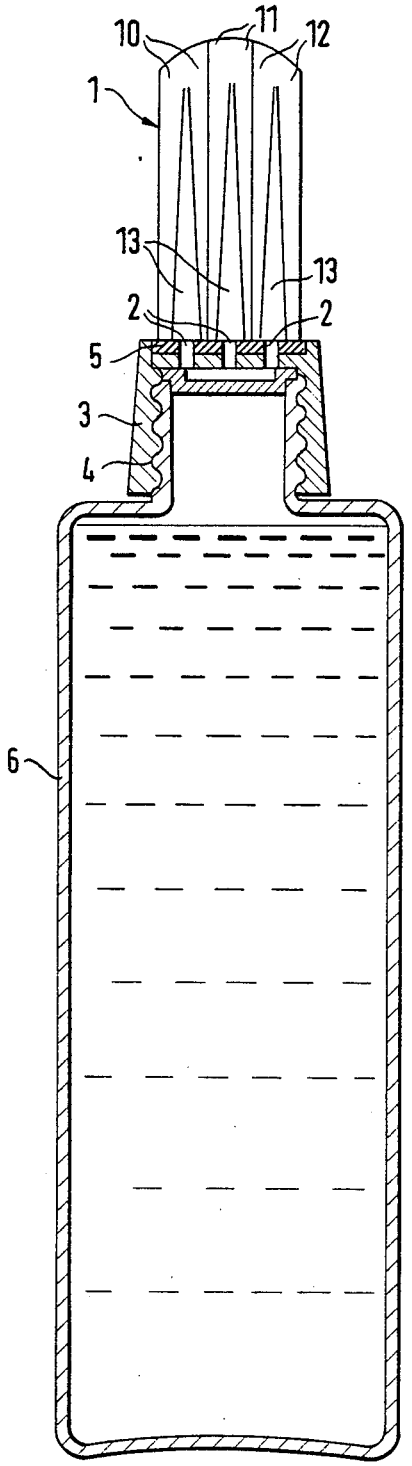
FIG. 1 shows a section of a lateral view of an applicating device having a bottle.
Figure 2:
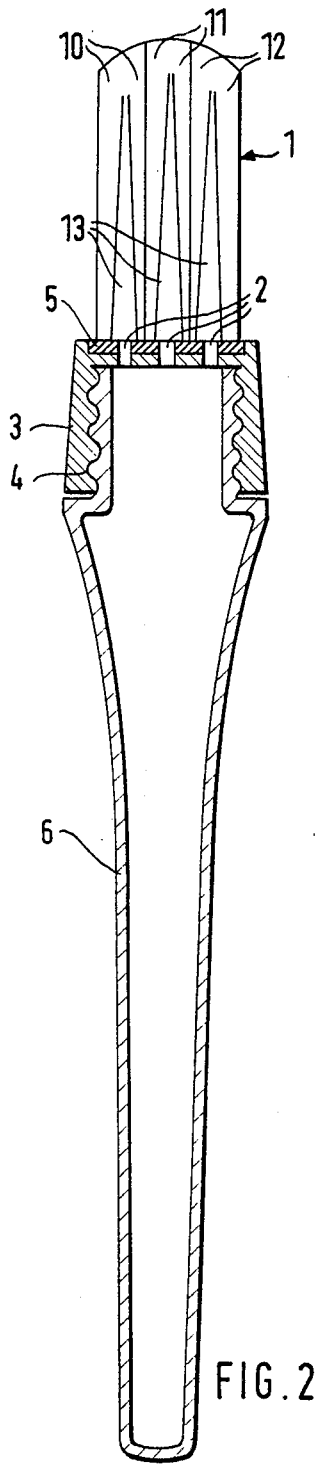
FIG. 2 shows a section of a lateral view of a brush having a hollow handle.
Figure 3:
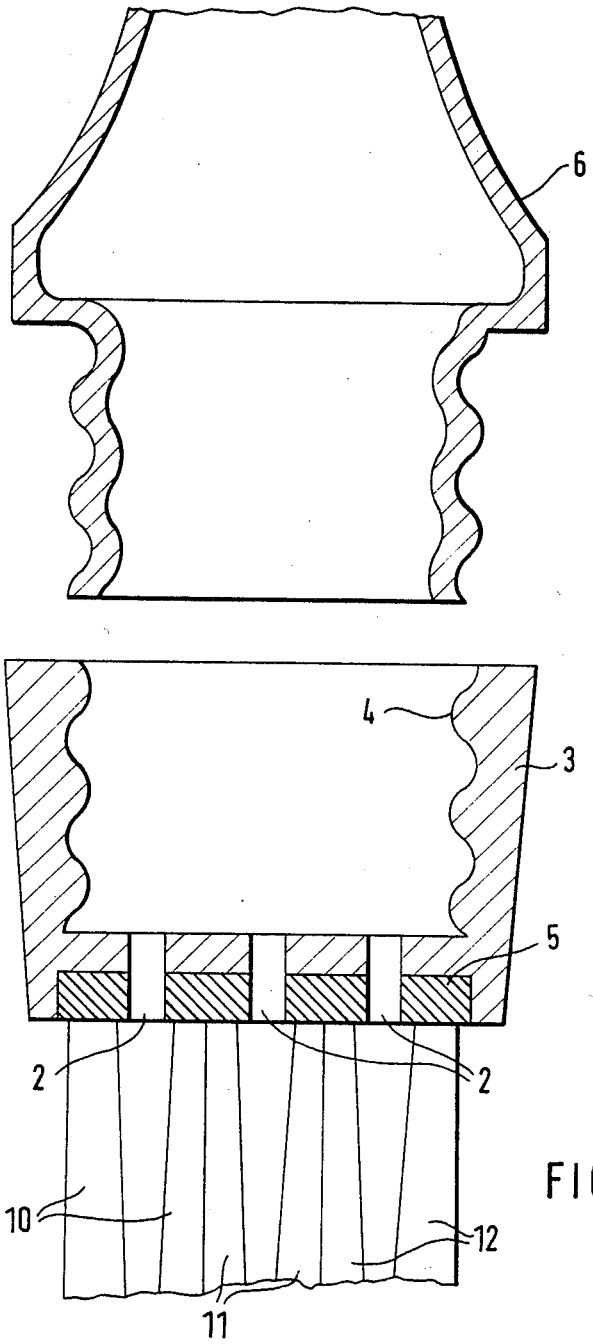
FIG. 3 shows, on an enlarged scale a section of a lateral view of the screwed-on lid or cap of a device shown in FIGS. 1 and 2.

The devices shown in FIGS. 1 and 2 each include a storage container 6 having a screw cap 3, the upper side of which carries a base 5 having openings 2 that is covered with bristles 1. The cap 3, via a thread 4, is screwed to the storage container 6. The openings 2 of the base 5 are, each separately, surrounded by the bristles 1 of bundle of bristles 10, 11, 12 so that a duct 13 is formed within each bundle of bristles that narrows in the direction of the bristle ends and is closed there directly by the bristles 1. The openings 2 in the base 5 are continued in corresponding openings in the upper part of the cap 3 so that together ducts are formed for the passage of the agent.

Each bundle 10, 11, 12 is butt-welded on the base 5 which itself is formed by a thin plastic disk. After the welding-on of the bristles 1, the base 5 is mounted at the cap 3 of the container 6; for example, it may be welded in, glued or attached in some other way.

Instead of arranging one bundle 10, 11, 12 of bristles around the opening edge of each hole 2, one single bundle of bristles of a correspondingly larger outside diameter may also be used which then, according to the number of holes, would have several ducts for the flowing-through of the agent.

Figure 4:
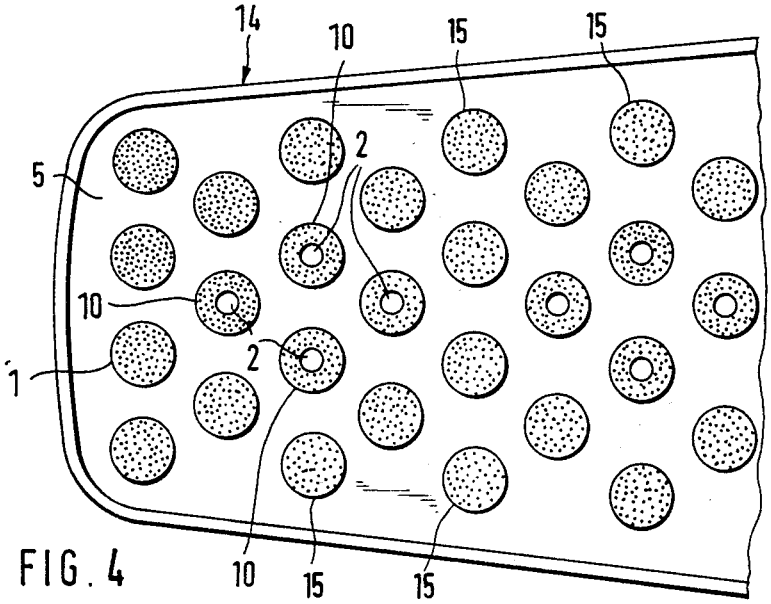
FIG. 4 shows a truncated top view on a brush having a hollow brush body.
Figure 5:
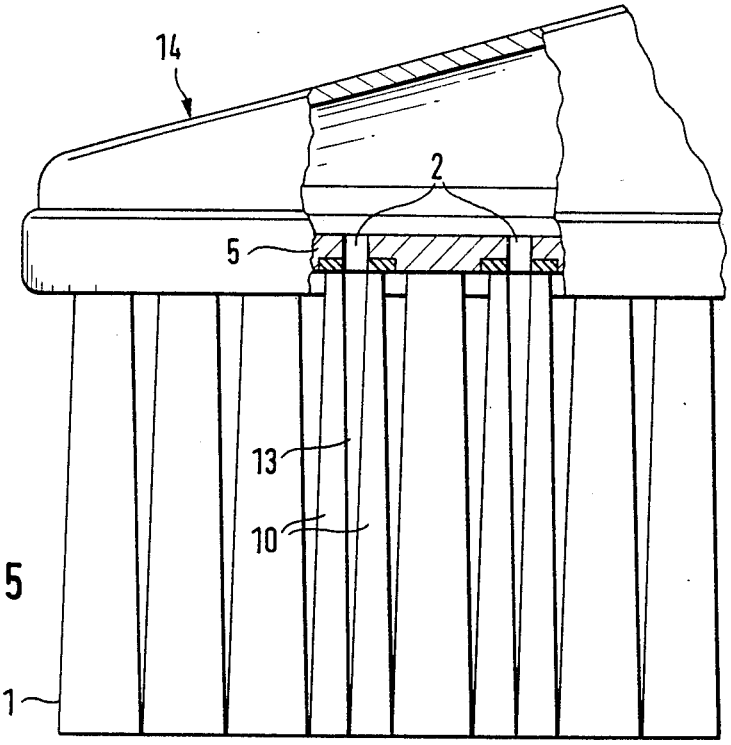
FIG. 5 shows a partial section of a lateral view of the embodiment according to FIG. 4.

As shown most clearly in FIGS. 4 and 5, the bundles 10 of bristles arranged in the area of the central longitudinal axis, in each case, surround the edge of openings 2 arranged in the bottom of the brush housing and continued in the inserted thin-walled base 5. No openings exist outside the longitudinal central areas so that the bundles 15 of bristles located on the outside which are also butt-welded, do not carry any agents. The cleaning brush may be provided with a water-supply connection for a continuous supply of the agent and in addition, or instead, may be provided with a filling hole having a cap 1 for the filling-in of the cleansing agents.

Figure 6:
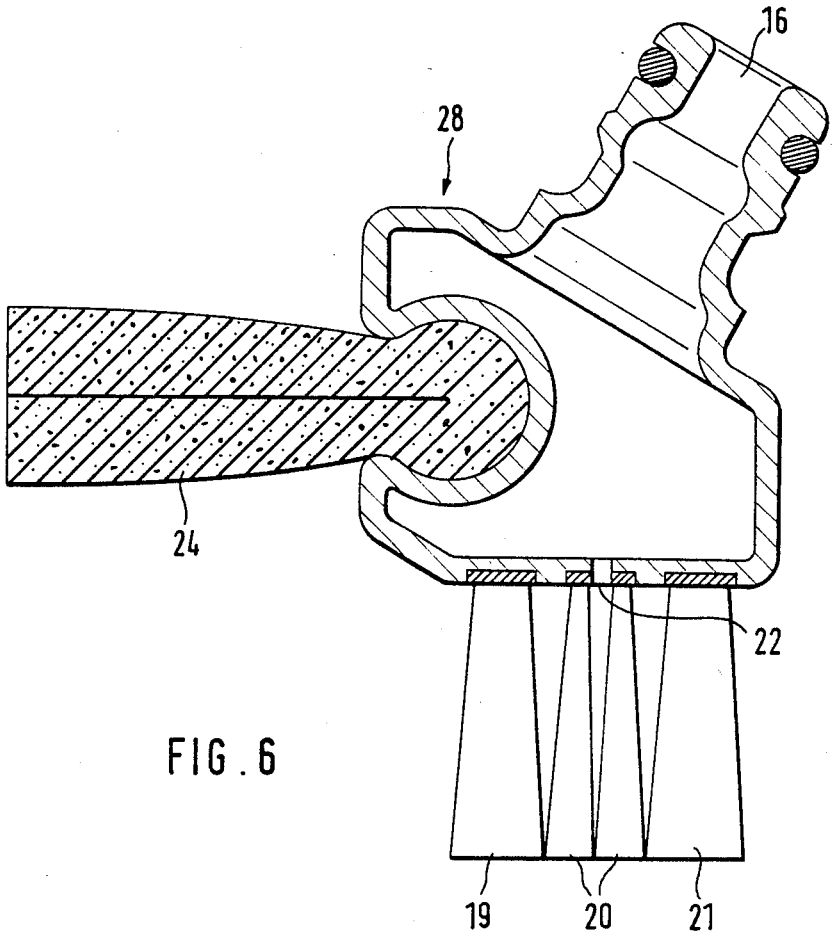
FIG. 6 shows a section of a lateral view of another embodiment of a cleaning device.

The cleaning device shown of in FIG. 6 has a hollow head 28 provided with a water-supply connection 16 and two working sides. One side has three rows of strip-shaped bundles 19, 20, 21 of bristles, in which case the bristles of the central strip 20 of bristles enclose a slot-shaped break-through 22 in the bristle base. The other working side of the device head 28 is provided with a water pusher 24 made, for example, of hard rubber or sponge.

Figure 7:
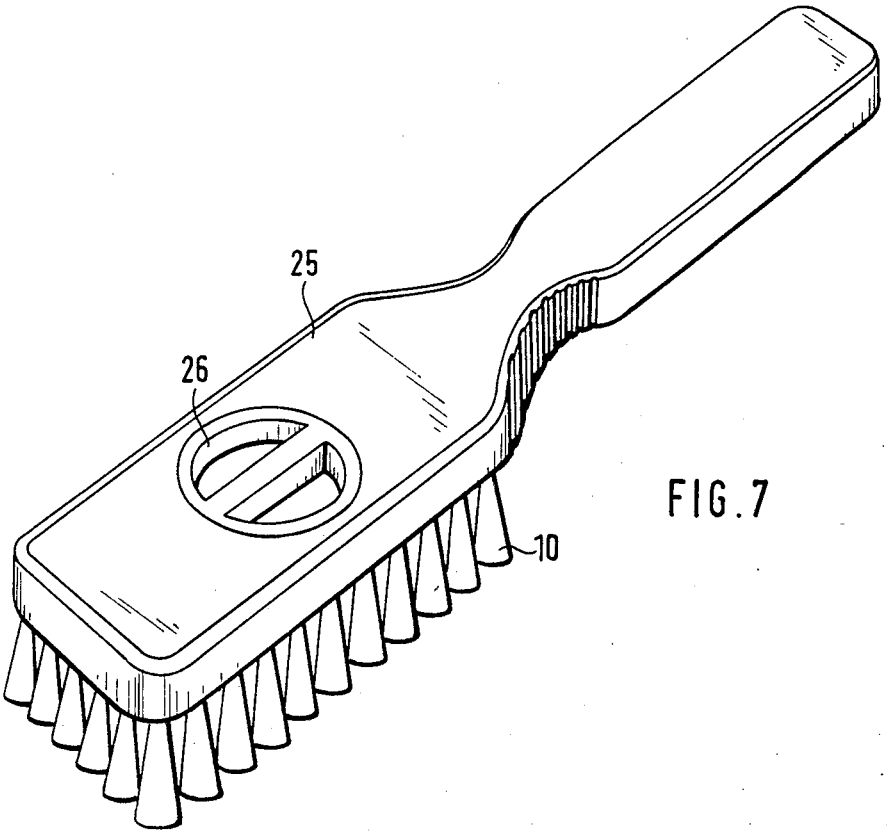
FIG. 7 is a perspective presentation of a hair-dyeing brush.
Figure 8:
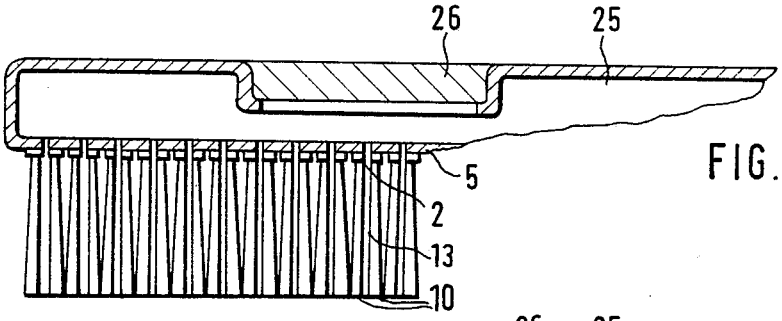
FIG. 8 shows a truncated lateral view of the embodiment according to FIG. 7 as a section through the bundles of bristles.
Figure 9:
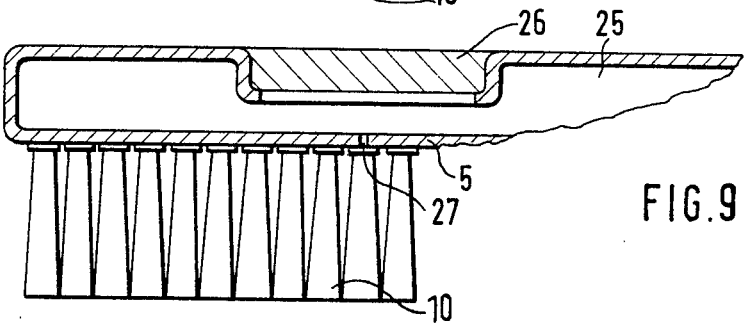
FIG. 9 shows a truncated lateral view of the embodiment according to FIGS. 7 and 8 as a section between the bundles of bristles.

The hair-dyeing brush of FIGS. 7 to 9 has a hollow brush body 25 with a filling hole 26. The bundles 10 of bristles are arranged in rows on the thin-walled base 5 which, in this case, is formed directly by the bottom of the brush body. The bristles 1 of each bundle 10 of bristles surround one opening 2 each in the base 5 and form a duct 13. If necessary, more openings 27 in the base 5 may be arranged between the bundles 10 of bristles in FIG. 9.

Figure 10:
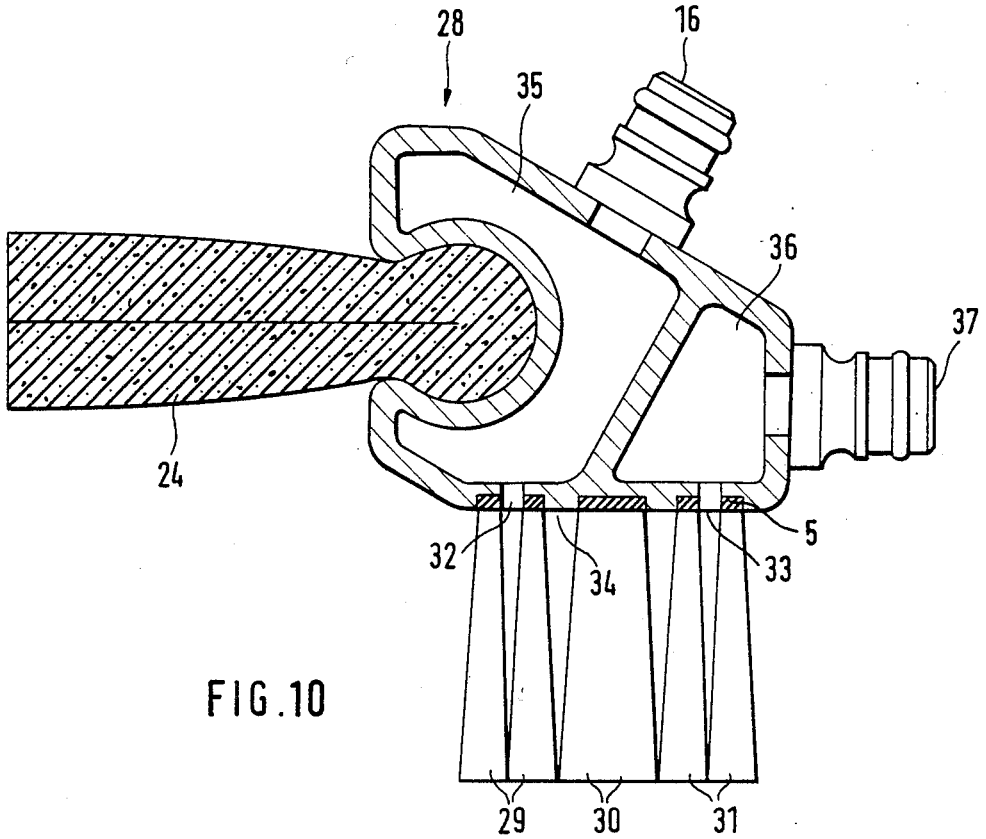
FIG. 10 shows an embodiment of a device where the agent is returned that is similar to FIG. 6.

FIG. 10 shows an embodiment of a combined device that is similar to that of FIG. 6, having a bristle attachment consisting of several strip-shaped bundles 29, 30, 31 of bristles disposed next to one another and a water pusher 24. The two outside bristle strips each surround a slot 32, 33 in the base 5 or in the bottom 34 of a hollow device head 28 which is divided into two chambers, with one chamber 35 being provided with a connection 16 for the agent and the other chamber 36 being provided with a drain 37 for the agent. The agent which, via the chamber 35 and the slot 32, is led to an outside bristle strip 29 reaches the surface to be worked or treated. Superfluous amounts of agent located therein, via the other outside bristle strip 31, can be taken in again, and via the slot 33, the chamber 36 and the drain 37 can, in a circulating manner, either be returned to the connection 16 or, if it is soiled and dirty, be drained out. This embodiment is suitable for cleaning, sweeping and applying and similar devices.

I claim:

1. A device for applying a liquid agent, the device comprising a plurality of bundles of synthetic bristles, a thin-walled plastic supporting base forming a part of container accommodating said liquid agent, said plastic supporting base having the bristles of the respective bundles of bristles butt-welded thereto, a plurality of openings provided in said plastic supporting base for supplying the agent to the bristles, the bristles of the respective bundles closely adjoining one another and completely surrounding at least one of said openings in the supporting base and forming a duct that tapers in a direction toward the free ends of the bristles for guiding said liquid agent to the free ends thereof opposite the supporting base.

2. A device according to claim 1, wherein the bristles of each bundle are spaced at a distance from an edge of the respective openings.

3. A device according to one of claims 1 or 2, wherein the bristles of a bundle surround several openings forming only a single tapered duct.

4. A device according to claim 3, wherein each bundle of bristles includes a mixture of different types of bristles.

5. A device according to claim 4, wherein the bristles have one of an oval, triangular, and round cross section.

6. A device according to claim 5, wherein at least one of the bundles has an angular cross section.

7. A device according to claim 6, wherein the thin-walled member forming the supporting base is pliable.

8. A device according to claim 7, wherein a part of the duct formed by the bundles of bristles is connected to a means for returning the liquid not used in a working area.

9. A device according to claim 1, wherein the thin-walled member forming the supporting base is one of a lid of the container and a part of the container.

10. A device according to one of claims 1, 2, or 9, wherein the openings in the supporting base have a configuration selected from the group of configurations consisting of partly circular, oval, angular, star-shaped and slot-shaped.

11. A device according to claim 1, wherein the liquid agent is supplied through at least one row of bundles of bristles with other rows of bundles of bristles being provided that, in each case, follow in a working direction, to permit unused liquid agent to be returned to an additional container of the device.

12. A process for manufacturing devices for applying liquid agents by bundles of synthetic bristles fixed on a pliable thin-walled supporting base provided with openings for supplying the liquid agent to the bundles of bristles, the method comprising the steps of pushing ends of the bristles of the bundles facing the pliable thin-walled supporting base from a center of the bundle toward an outside thereof until a cross-section free of bristles is created in the center of the bundle corresponding to at least a clear cross-section of an opening in the pliable thin-walled supporting base, and at least one of simultaneously and subsequently butt-welding the bristles onto the pliable thin-walled supporting base.

13. A process according to claim 12, further comprising the step of gripping the bundle of bristles while the bristles are pushed away from the center of the bundle from an outside of the bundle while maintaining a contour of the bundle of bristles.

14. A process according to one of claims 12 or 13, further comprising the step of shaping the openings in the pliable thin-walled supporting base at the time of the butt-welding of the bristles onto the pliable thin-walled supporting base.

* * * * *